United States Patent [19]

Eutebach

[11] Patent Number: 4,991,257

[45] Date of Patent: Feb. 12, 1991

[54] SLIDING DOOR APPARATUS

[75] Inventor: Peter Eutebach, Bad Salzuflen, Fed. Rep. of Germany

[73] Assignee: DORMA - Glas Gesellschaft fuer Glastuer - Beschlaege und-Konstruktionen GmbH, Bad Salzuflen, Fed. Rep. of Germany

[21] Appl. No.: 322,099

[22] Filed: Mar. 9, 1989

[30] Foreign Application Priority Data

Mar. 9, 1988 [DE] Fed. Rep. of Germany ... 8803188[U]

[51] Int. Cl.[5] ..... E05D 15/00

[52] U.S. Cl. ..... 16/87 R; 16/90; 16/94 R; 16/95 R; 16/96 R; 49/127; 49/409; 160/196.1; 104/94; 104/246

[58] Field of Search ..... 16/87 R, 90, 94 R, 95 R, 16/96 R, 97, 106; 160/196.1, 199; 49/409–412, 127; 104/94, 139, 246

[56] References Cited

U.S. PATENT DOCUMENTS 4,829,631 5/1989 Araya ..... 49/409

*Primary Examiner*—Kurt Rowan
*Assistant Examiner*—Edward A. Brown
*Attorney, Agent, or Firm*—Ralph H. Dougherty

[57] ABSTRACT

A sliding door apparatus for installation in a structural opening, having overhead runway rails with tracks or runways in which guide rollers of the sliding doors are mounted in a displaceable arrangement, additional cylindrical guide pins (pilots) (14) being provided as guides on switches which project downwardly into the runways (20) and which have centers that lie on assumed center lines of the runways (20).

8 Claims, 2 Drawing Sheets

SLIDING DOOR APPARATUS

The present invention relates to a sliding door apparatus having overhead runway rails to be installed in a structural opening or aperture, and from which sliding doors (or sliding wings) are suspended in a displaceable arrangement.

A conventional means for mounting this type of sliding door provides additional runway rails that turn or angle away from, and/or branch off to be parallel with, a main runway rail arranged along the structural aperture and in which guide rollers or the like can be displaced. In this case, each of the outer end areas of a sliding door (a sliding door wing) is provided with upwardly projecting guide rollers, all of which run in the main runway rail when the sliding door presents a closed face. As soon as sliding doors or sliding door wings are opened, one guide roller arranged at one end remains in the main runway rail, while guide rollers mounted at the other end of the sliding door wing pivot into additional secondary rails that run parallel with or at an angle from the main runway rail. For this purpose, secondary runway rails are mounted on the main runway rail at an acute or right angle; the guide rollers enter the grooves (runways) of these secondary runway rails and remain there when the door wing is open. With runway rails known from the prior art, the runway grooves join at a right angle or at an acute or obtuse angle. This gives rise to corners and edges against which the guide rollers can strike.

It is the principal object of the invention to provide a sliding door apparatus (sliding face of a door) incorporating special guides or the like that act as switches to prevent the guide rollers from striking against corners or edges, or from tilting or binding.

This and other objects are achieved with a sliding door apparatus of the type mentioned in that guide pins or pilots forming a turning point like a switch for the guide rollers project into the runways, which receive the guide rollers and are at an angle from each other (branching angle), so that these guide rollers run through the turning points without striking against corners or edges or tilting.

These switch pins or pilots to be incorporated in the runways of the runway rails can, depending on the guide roller type, be arranged with suitable directions and intervals in the turning areas of the main runway rail and the secondary runway rails. These switch pins or overhead runway rail, project downwardly into the runway or the runways and engage the space between two adjacent guide rollers where the door wing is suspended. For this reason, the diameter of the switch pins or pilots is preferably only slightly smaller than the space between two adjacent guide rollers, which are mounted on carriages bearing the door wings.

The guide rollers are thus given improved guidance in turning so that they will not tilt or strike against corners or edges, and the door wings or the like can be properly opened or closed. The use of carriages as connecting elements between the door wing and the guide (support) rollers results in outstanding operating characteristics. With the projecting guide pins or the like according to the invention, the guide rollers provide for smooth movement in the angled areas of the runway rails.

Further features of the invention will be seen in the dependent claims. The invention relates not only to the individual features, but also to those set forth in the dependent claims.

A preferred embodiment of the invention is shown in the drawings, in which.

Figure 1:
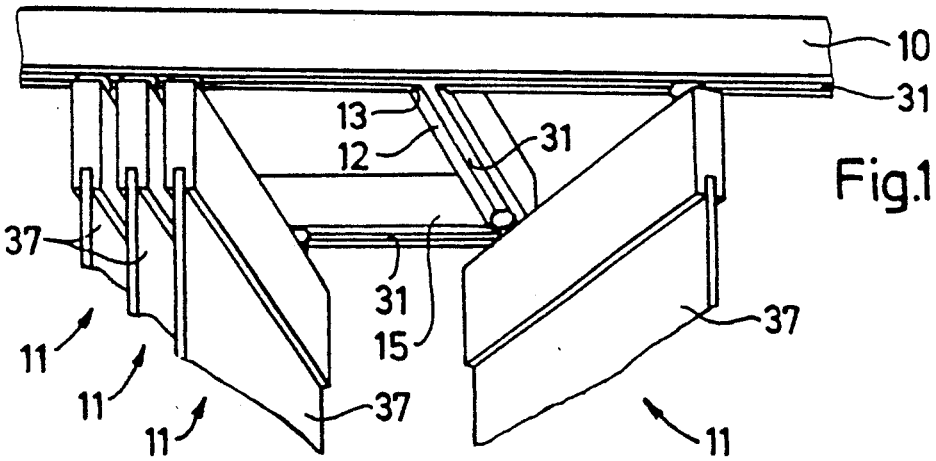
FIG. 1 is a perspective view of sliding doors of a sliding face of a door in parking position.

Referring now to the drawings, a sliding face of a door is characterized by a plurality of sliding doors 11 arranged so that they can be moved in a runway rail 10, which is designed in one or both of its end areas so that a plurality of sliding doors 11 clearing an entrance or passageway can be parked there with a minimum space requirement. For this purpose, the runway rail 10 is connected at a right angle with a second runway rail 12, the rail 10 having a mitering groove 13 to receive said second rail. The two miter lines meet at a point lying precisely on an assumed longitudinally running center line of the runway rail 10.

The rail 12 is cut for mitering on both sides of an assumed longitudinally running center line so that it can be inserted with a precise and flush fit into the mitering groove 13 of the runway rail 10. The miter edges lying together in this way are joined with each other, preferably by welding.

Pilots 14 with a circular cylindrical cross-section and designed as guide or switch pins are mounted on the horizontally running center line of the runway rail 10 and the vertical center line on said center lines. The intersection of the two center lines defines the center for a pilot 14. Located on both sides of said pilot are further pilots 14 lying equidistantly on the horizontal center line and equidistantly on the vertical center line. A third runway rail 15 is connected at the other face of the rail 12 turned away from the rail 10. Here too, the rails 12, 15 are cut for mitering and joined by welding so that the two rails are at a fixed angle with respect to each other.

The intersection of the vertical center line with the center line of the third runway rail 15 is the center for a pilot 14. Located equidistantly on the vertical center line and on the center line of the third runway rail 15 are further pilots 14 so that their centers lie on the aforementioned center lines. This describes the location of guide or switch pins as mounted for runway rails 12, 15 joined by mitering at an angle, the first description of the location of guide or switch pins being used for a longitudinal runway rail 10 arranged bilaterally at an angle with respect to a runway rail 12.

Figure 4:
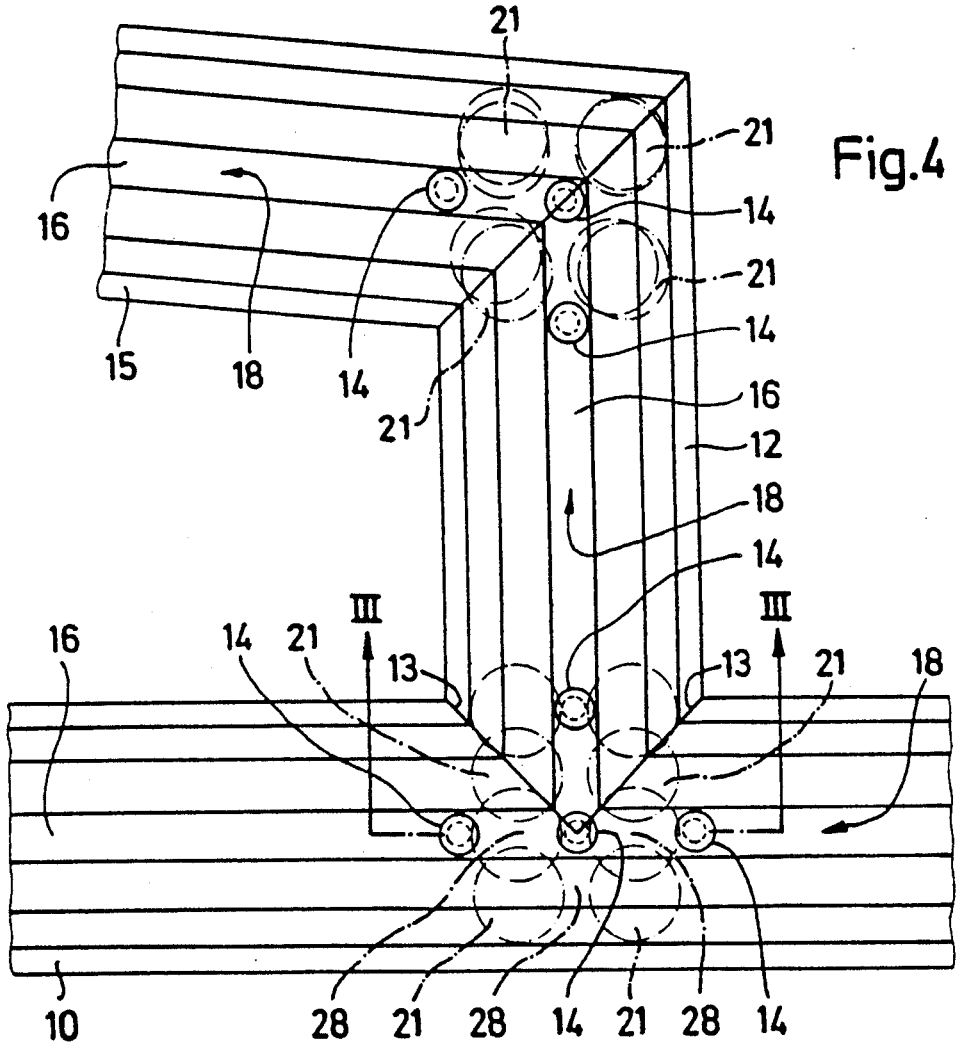
FIG. 4 is a plan view of the guide rails in the arc of the parking position with motion caused by the switch pins.

The guide or switch pins are characterized by two one-piece pilots **14*a*, 14*b* having different diameters. After the runway rails 10, 12, 15 have been joined (as shown in FIG. 4), holes 17 are drilled into a cross-piece 16 connecting the two halves of a runway rail, said holes being centrally arranged in the cross-piece 16. The latter is inserted with the smaller-diameter pilot 14*a* through a longitudinally oriented slot opening 18 of the runway rail into the hole 17 and pushed into this hole until the circular end face 19 of the larger-diameter pilot 14*b* comes to lie on the surface of the cross-piece. The smaller-diameter pilot 14*a* projects partway into a runway (or track) 20 for guide rollers 21**.

Figure 3:
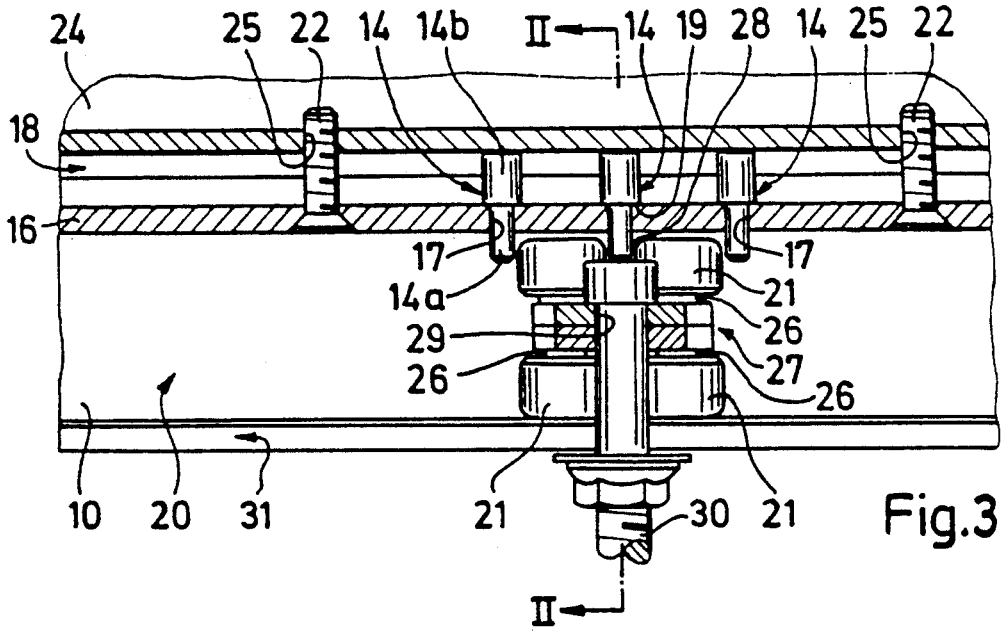
FIG. 3 is a sectional view of the area about the switch pins taken along line III—III of FIG. 4.

The runway rails joined together as shown in FIG. 4 can now be fastened with screws 22 to a sectional beam 24 fixed in a cover plate 23, the sectional beam 24 having tapped holes 25 for the screws 22 as shown in FIG. 3. The longitudinal slot opening 18 of the runway rail serves here as a feed-through opening for the screws 22.

Figure 2:
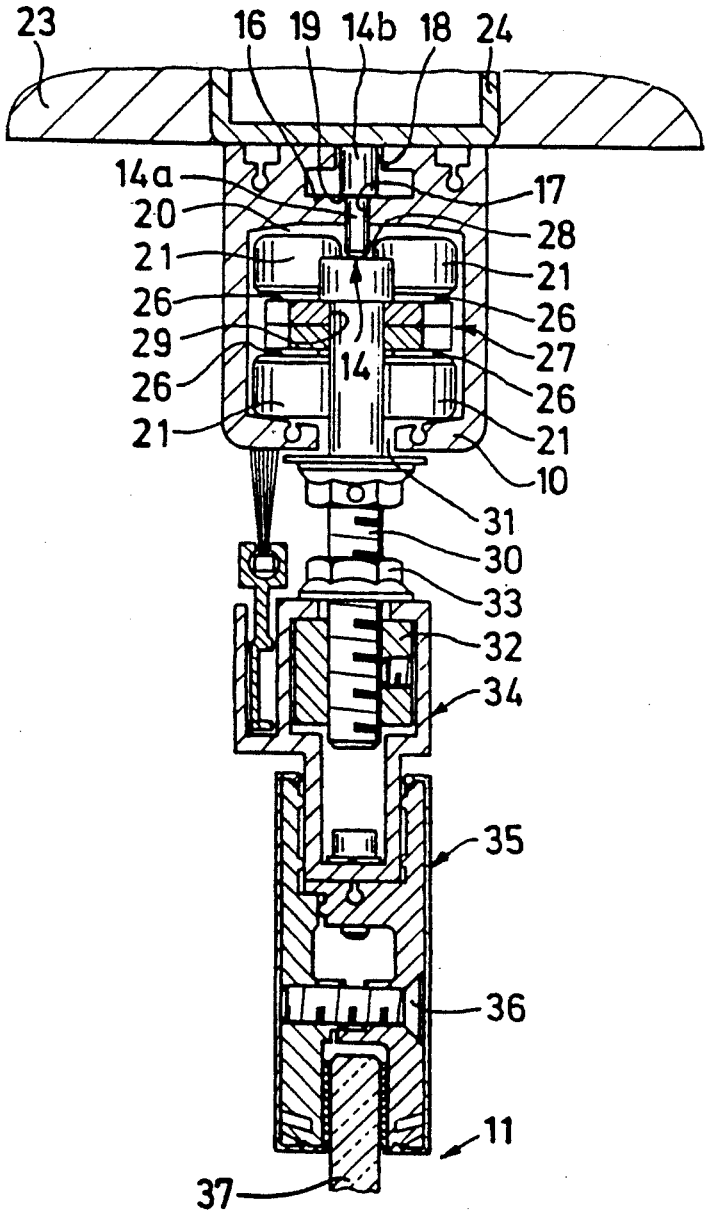
FIG. 2 is a vertical section taken along line II—II of FIG. 3.

The guide rollers 21 in the runway 20 rotate with their axis vertical by means of a pilot 26 in a mounting plate 27 and, as can be seen in FIGS. 2 and 3, four rollers 21 are in a square arrangement above and below the mounting plate 27. The upper four rollers 21 lie precisely over the bottom four rollers 21; that is, an upper roller and a bottom roller 21 always lie on one axis. In addition, the rollers 21 are mounted so that two opposing rollers 21 form a port 28 for the pilot **14*a* projecting into the runway 20, the port 28** being slightly larger than the diameter of the pilot.

The mounting plate 27 for the rollers 21 has a central, vertical hole 29 for passage of a screw 30 through a bottom, longitudinal slot opening 31 of the runway rail. A nut 32 and a lock nut 33 are used to mount a rail 34 held by two screws 30 and acting as an adapter in a separable arrangement at the bottom end of the aforesaid screw 30.

The rail 34 acting as an adapter is provided for separable mounting of another rail 35 in two parts in its bottom area; when a screw 36 arranged horizontally in the rail 35 is tightened, the two parts of this two-part rail 35 are joined together and clamp a glass disc 37 or glass plate acting as a door.

A significant advantage of the present invention is that switch or guide pins used in the mitering area of interconnected runway rails 10, 12, 15 guide the guide rollers 21 of a suspended sliding door in precisely this mitering area and thus serve as a switch for the new displacement direction of the door 11 that is to be taken. This prevents bending or tilting of the guide rollers 21 in this area and thus a time-consuming and bothersome direction change of the displacement motion of the door 11, for example, into the parking or stand-by position (see FIG. 4).

When the guide rollers 21, which rotate above and below the mounting plate 27 with the screw 30 passing from above through the central hole 29 of the mounting plate 27, run through a mitering area of interconnected runway rails with switch or guide pins used in this mitering area, the smaller-diameter pilots **14*a* project so far into the runway 20 that there is only a small gap between the face of the pilot 14*a* and the face of the head of the screw 30. The guidance of the guide roller 21 is thus adapted quite well to the structural conditions, because the addendum of the upper guide rollers 21 corresponds, as far as is possible, with the length of the pilot 14*a***.

The switch pins **14*a* form a T-shape relative to each other in the case of a right-angled switch, and they form a V-shape when the switch angle is greater than or less than 90 degrees. The drawings are on a scale of about 1:1.5. The diameter of a switch pin 14*a* is somewhat smaller (e.g., 5 mm) then the interval (runway 20) between two guide rollers 21** that measures 5.1 to 5.2 mm.

A further advantage of the invention is that the guide pins have a simple design (two pilots **14*a* and 14*b*** with different diameters, one-piece, and coaxial with each other) and can be mass-produced economically and rapidly. Guide pins can thus be stocked in different dimensions for various sizes (building-block systems) of runway rails and sliding doors, reclaimed as required to suit on-site structural conditions and used in a simple way in a mitering area.

What is claimed is:

1. Sliding door apparatus for installation in a structural opening with overhead runway rails having runways in which guide rollers of the sliding doors are mounted in a displaceable arrangement, characterized in that cylindrical guide pins (14) are provided as guides on switches which project downwardly into the runways (20) and which have centers that lie substantially on center lines of the runways (20).

2. Sliding door apparatus as described in claim 1, characterized in that the center of a guide pin (14) lies in the intersection of two center lines of two adjacent runways (20).

3. Sliding door apparatus as described in claim 1, characterized in that each guide pin comprises two portions having different diameters, the portion **(14*a*)** thereof with the lesser diameter projecting freely into the runway.

4. Sliding door apparatus as described in claim 3, characterized in that a circular end face (19) of the portion of each guide pin (14) having the larger diameter lies on the surface of a horizontal cross-piece (16) that is located above the runway (20) of a runway rail (10, 12).

5. Sliding door apparatus as described in claim 1, characterized in that the guide pins (14) are mounted in a removable arrangement in the runway rails (10, 12).

6. Sliding door apparatus as described in claim 1, characterized in that the guide rollers (21) are mounted in pairs at intervals from one another to rotate freely on a mounting plate (27), together forming a carriage that can be displaced in the runway (20) and on which the sliding door (11) is suspended.

7. Sliding door apparatus as described in claim 1, characterized in that the lesser diameter of each projecting guide pin **(14*a*) is somewhat smaller than the interval between adjacent guide rollers (21)**.

8. Sliding door apparatus as described in claim 1, characterized in that a first guide pin (14) lies in the center of an intersection of two center lines of two adjacent runways (20), and that a second guide pin (14) is located on the centerline of each runway, each such second guide pin being equidistant from said first guide pin (14).

* * * * *